US012390716B1

(12) United States Patent
Limb

(10) Patent No.: US 12,390,716 B1
(45) Date of Patent: Aug. 19, 2025

(54) CUSTOMIZABLE DICE WITH REMOVABLE FACE ASSEMBLIES

(71) Applicant: Jeffrey Limb, Herriman, UT (US)

(72) Inventor: Jeffrey Limb, Herriman, UT (US)

( * ) Notice: Subject to any disclaimer, the term of this patent is extended or adjusted under 35 U.S.C. 154(b) by 0 days.

(21) Appl. No.: 19/042,648

(22) Filed: Jan. 31, 2025

(51) Int. Cl.
*A63F 9/04* (2006.01)

(52) U.S. Cl.
CPC .... *A63F 9/0413* (2013.01); *A63F 2009/0491* (2013.01)

(58) Field of Classification Search
CPC ..... A63F 9/0413; A63F 2009/0491; B65D 21/0215; A63H 33/003
USPC ..... 273/146
See application file for complete search history.

(56) References Cited

U.S. PATENT DOCUMENTS

| | | | | |
|---|---|---|---|---|
| 1,100,549 | A * | 6/1914 | Elkins | A63F 9/0415 273/299 |
| 9,858,827 | B2 * | 1/2018 | Shirvani | G09B 1/36 |
| 10,617,968 | B2 * | 4/2020 | Davis | A63H 33/108 |
| 2020/0054938 | A1 * | 2/2020 | Barwald | A63F 9/0413 |

FOREIGN PATENT DOCUMENTS

WO WO-2020115691 A1 * 6/2020

OTHER PUBLICATIONS

Dice Forge Review, by the Thoughtful Gamer, Nov. 6, 2018, published at https://thethoughtfulgamer.com/2018/11/06/dice-forge-review/ (Year: 2018).*

* cited by examiner

*Primary Examiner* — Michael D Dennis
(74) *Attorney, Agent, or Firm* — Mohr Intellectual Property Law Solutions, PC

(57) ABSTRACT

A customizable die including a body and face assemblies. The body defines a polyhedron with sides and a socket in each side. The customizable die includes a face assembly for each side of the polyhedron. Each face assembly is configured to selectively mount to the body in the sockets. Each face assembly includes a frame and a face member. The frame is complementarily configured with the socket and configured to selectively mount within the socket. The frame defines a recess. The face member is configured to selectively mount to the frame. The face member includes a stud and a display member. The stud is complementarily configured with the recess and configured to insert into the recess to selectively mount the face member to the frame. The display member is coupled to the stud and includes an outer surface opposite the stud for displaying a die outcome display.

20 Claims, 5 Drawing Sheets

CUSTOMIZABLE DICE WITH REMOVABLE FACE ASSEMBLIES

BACKGROUND

The present disclosure relates generally to dice. In particular, customizable dice with removable face assemblies are described.

Dice are commonly used in games to generate substantially random values with relevance to a game. For example, a die may display pips or numbers corresponding to how many game squares a player may move in a turn. Additionally or alternatively to pips and numbers, a die may display a symbol, letter, or word with gameplay significance, such as instructions in a party game to "Sing" a song or to tell a "Joke" in a gameplay round.

Conventional dice have limitations and shortcomings. For example, existing dice generally have fixed displays rather than displays that can be customized. Fixed, general use dice with pips may not be as tailored to the gameplay rules of a given game. It would be desirable to have a die that could be readily customized to a particular game one wishes to play.

There are existing examples of dice that can be customized to suit different games. However, the existing examples of customizable dice are not entirely satisfactory.

For instance, existing examples of customizable dice do not enable readily and securely snapping in new faces. Instead, conventional customizable dice rely on cumbersome, less secure, and/or awkward methods to change the faces displayed, such as puzzle-piece type interlocking methods and/or individually secured abutting display elements.

Further, conventional customizable dice do not allow for different face shapes to be used in a given die. For example, it would be desirable for some gameplay methods to have a die with multiple square faces and one round face. Different shaped faces may be used to signify different gameplay outcomes.

Another drawback of conventional customizable dice is that they have limited customization options. For example, conventional customizable dice are typically limited to replacing die faces. Conventional customizable dice capable of mounting separate side-by-side indica carrying elements must be done so individually rather than as an assembled unit. It would allow for more complex and sophisticated gameplay options if additional die features could be customized beyond die faces or without requiring elements to be mounted individually.

Thus, there exists a need for customizable dice that improve upon and advance the design of known customizable dice. Examples of new and useful customizable dice relevant to the needs existing in the field are discussed below.

Disclosure addressing one or more of the identified existing needs is provided in the detailed description below. Examples of references relevant to customizable dice include WO1994025130A1 and U.S. Patent References U.S. Pat. No. 8,408,549B2, US20110042891A1, and US20110101607A1. The complete disclosures of the above patents and patent applications are herein incorporated by reference for all purposes.

SUMMARY

The present disclosure is directed to a customizable die. The customizable die includes a body and face assemblies. The body defines a polyhedron with sides and a socket in each side.

The customizable die includes a face assembly for each side of the polyhedron. Each face assembly is configured to selectively mount to the body in the sockets. Each face assembly includes a frame and a face member.

The frame is complementarily configured with the socket and configured to selectively mount within the socket. The frame defines a recess.

The face member is configured to selectively mount to the frame. The face member includes a stud and a display member. The stud is complementarily configured with the recess and configured to insert into the recess to selectively mount the face member to the frame. The display member is coupled to the stud and includes an outer surface opposite the stud for displaying a die outcome display.

DETAILED DESCRIPTION

Figure 1:
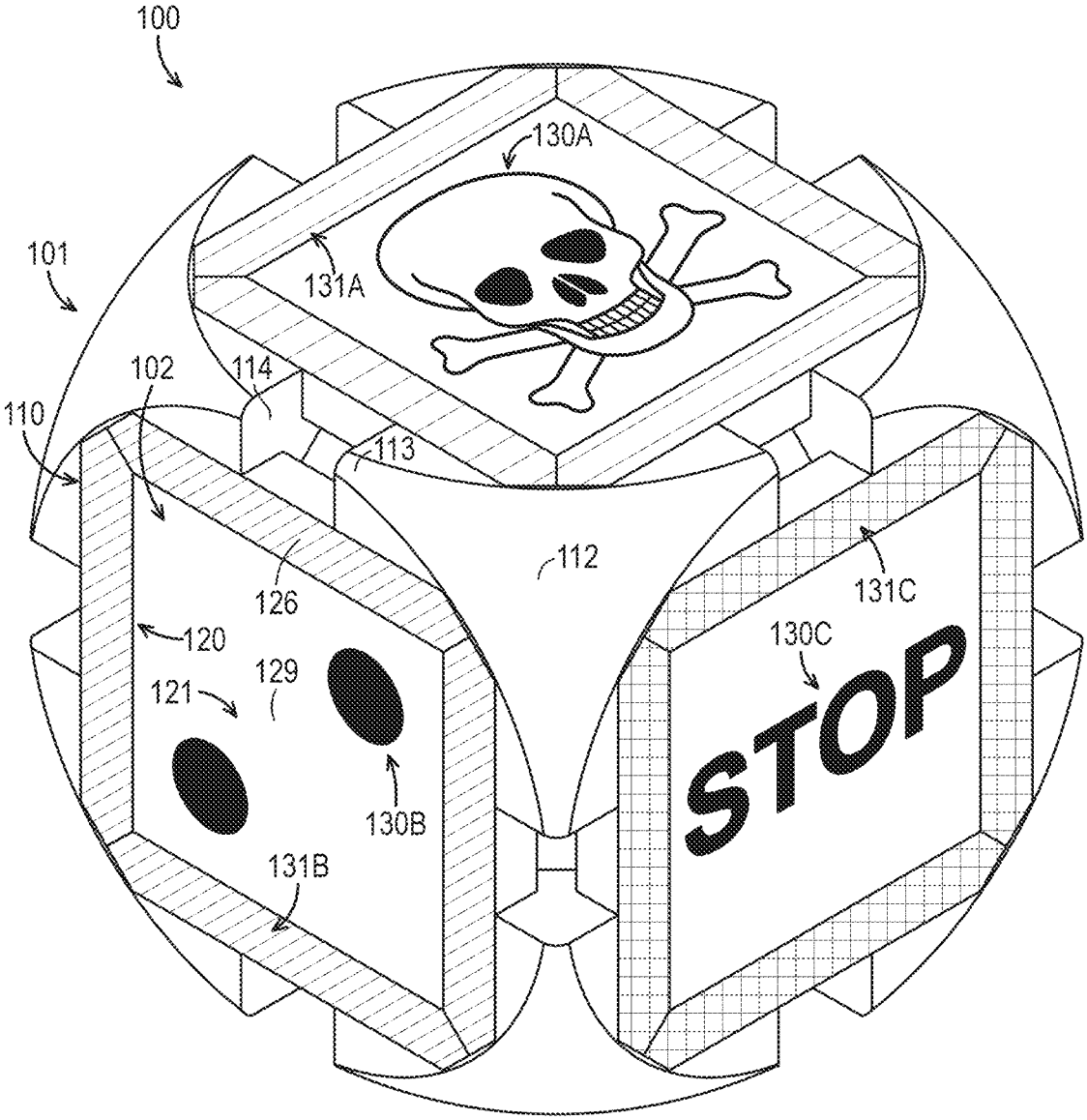
FIG. 1 is a perspective view of a first example of a customizable die.

The disclosed customizable dice will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various customizable dice are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Customizable Dice with Removable Face Assemblies

With reference to the figures, customizable dice with removable face assemblies will now be described. The customizable dice discussed herein function to present different die outcome displays with gameplay significance on a substantially random basis when the customizable dice are thrown. Substantially random in this document means that each face of the customizable die tends to come to rest in an upward position with nearly equal apparent probability with any differences in actual probability being unapparent. The customizable dice described in this document also function to enable a user to selectively change faces of the die.

The reader will appreciate from the figures and description below that the presently disclosed customizable dice address many of the shortcomings of conventional dice and of conventional customizable dice. For example, the novel customizable dice discussed herein are not limited to fixed displays like conventional dice, but instead are configured to allow a user to change dice displays when desired. As a result, the novel customizable dice can be tailored to the gameplay rules of a given game.

Unlike conventional customizable dice that rely on cumbersome, less secure, or awkward methods to change the faces displayed, the novel customizable dice presented in this document enable readily and securely snapping in new faces. Further, the novel customizable dice allow for different face shapes to be used in a given die, such as to configure a die with multiple square faces and one round face. Accordingly, the novel customizable dice enable different shaped faces to be used to signify different gameplay outcomes.

Another advantage of the novel customizable dice is that they have increased customization options beyond conventional customizable dice. Unlike conventional customizable dice that are limited to replacing die faces, the novel customizable dice enable replacing frames surrounding each face in addition to replacing the faces. The frames can be used to display indicia independent of the faces. As a result, the novel customizable dice allow for more complex and sophisticated gameplay options than is possible with conventional customizable dice.

Desirably, the customizable faces and frames of the novel customizable die can be combined as integrated face assemblies. The integrated face assemblies can be preconfigured or preassembled. Integrated face assemblies conveniently makes it possible to replace all indica carrying elements on a side of a die all at once.

Customizable Die Embodiment One

Figure 5:
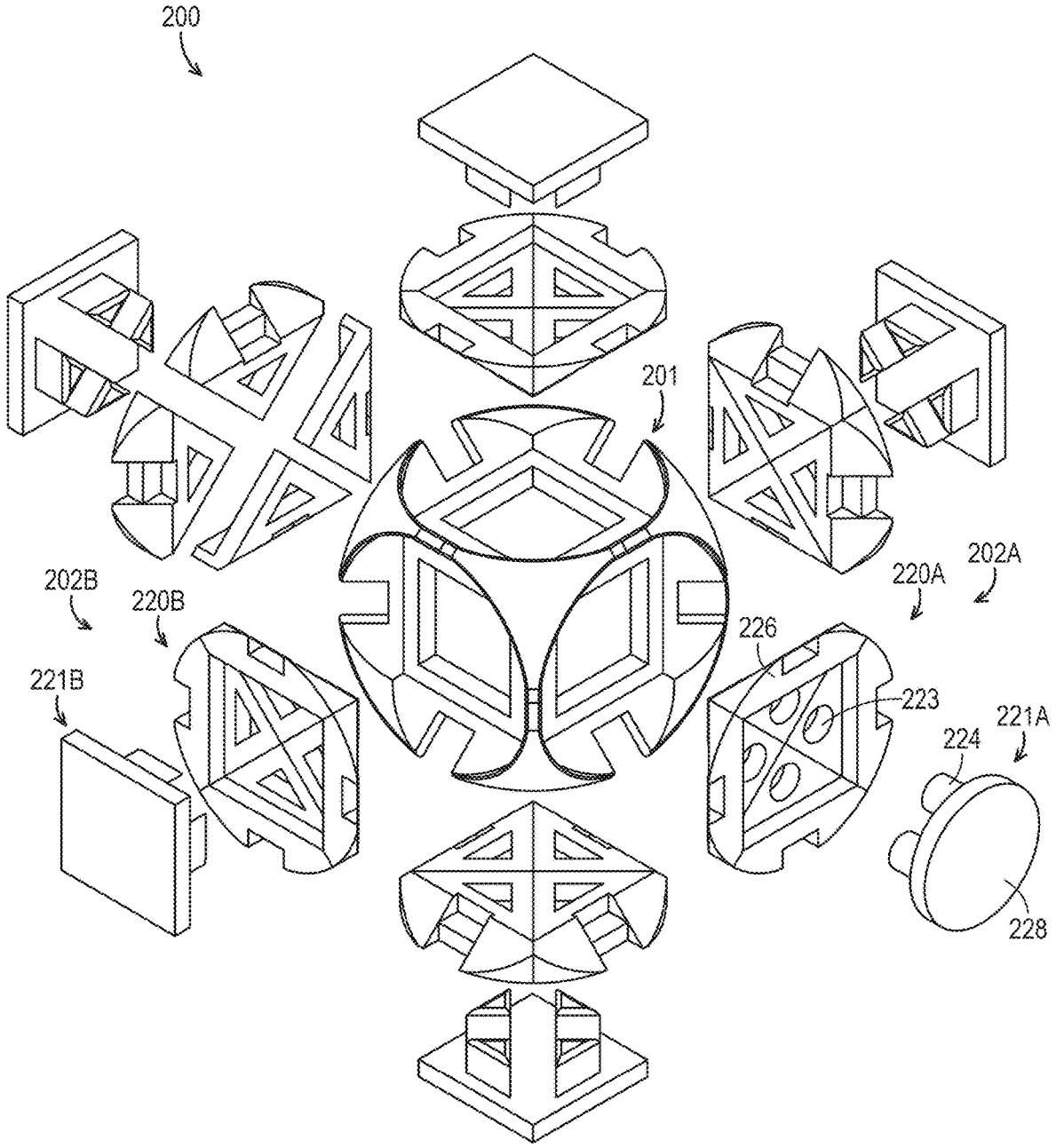
FIG. 5 is an exploded view of a second example of a customizable die.

With reference to FIGS. 1-4, a first example of a customizable die, customizable die 100, will now be described. A second example of a customizable die, customizable die 200, is depicted in FIG. 5 and discussed in the Embodiment Two section.

Customizable die 100 includes a body 101 and face assemblies 102. In some examples, the customizable die does not include one or more features included in customizable die 100. In other examples, the customizable die includes additional or alternative features. The components of customizable die 100 are discussed in the sections below.

Throwing or rolling customizable die 100 results in a die outcome display. A die outcome display is defined by indicia displayed on whichever face assembly 102 is oriented in a selected position when customizable die 100 comes to rest. Conventionally, the selected position of a die is the topmost side of the die, but could be any side of the die.

The indicia defining the die outcome display may be pips, numbers, letters, words, phrases, symbols, pictures or other graphics, colors, patterns, and combinations thereof. For example, FIG. 1 demonstrates indicia 130A in the form of a skull-and-crossbones graphic; indicia 130B in the form of two pips; and indicia 130C in the form of the word "stop."

Further, as explained in more detail below, FIG. 1 demonstrates examples of secondary indicia 131A-C depicted on border portions 126 of frames 120. For example, FIG. 1 demonstrates secondary indicia 131A in the form of horizontal lines around graphics indicia 130A; secondary indicia 131B in the form of diagonal lines around pips indicia 130B, and secondary indicia 131C in the form of gridlines around word indicia 130C.

The size, shape, and configuration of the customizable die varies in different examples. Some customizable die examples are relatively small, and others are relatively large. Additionally or alternatively to the overall volume of the customizable die, the weight of the customizable die may vary for a given volume. For example, some customizable die examples are configured to be relatively heavy for a given size while other examples are relatively light for the same given size.

The overall shape of the customizable die will differ in different examples. While customizable die 100 is a six-sided polyhedron, other examples will include different numbers of sides and therefore have different polyhedron shapes. For example, the customizable die may be configured as a 4-sided polyhedron, a 20-sided polyhedron, or a 100-sided or more polyhedron, each of which would have a different overall shape. Customizable dice from 4 sides to 100 or more sides are contemplated.

The reader should understand that references to polyhedron shapes are meant to refer to geometrically approximate polyhedrons rather than geometrically absolute polyhedrons. As FIG. 1 demonstrates, customizable die 100 includes rounded corners and notches that deviate from the shape of a true polyhedron. However, the overall shape of customizable die 100 is approximately that of a polyhedron.

Body

Body 101 functions to provide the overall shape and structure of customizable die 100. Further, body 101 supports face assemblies 102 selectively mounted to it. Body 101 also includes features to facilitate selectively removing face assemblies 102 mounted to body 101.

As can be seen in FIGS. 1-4, body 101 defines a polyhedron with sides 110 and corner members 112 at each vertex of the polyhedron. FIGS. 1-4 further demonstrate that body 101 defines edge members 113 along peripheral edges of the sides of the polyhedron. Edge members 113 extend between corner members 112.

In the example shown in FIGS. 1-4, body 101 defines a polyhedron with six sides 110. However, the body may define polyhedrons with 4 to 100 or more sides in other examples. The polyhedrons may be regular or irregular based on the desired outcome characteristics for the customizable die.

Corner members 112 and edge members 113 collectively define outer peripheries of sides 110 and therefore of body 101. Accordingly, corner members 112 and edge members 113 are in contact with support surfaces, such as tabletops, when customizable die 100 is thrown during a game to yield a die outcome display.

Figure 2:
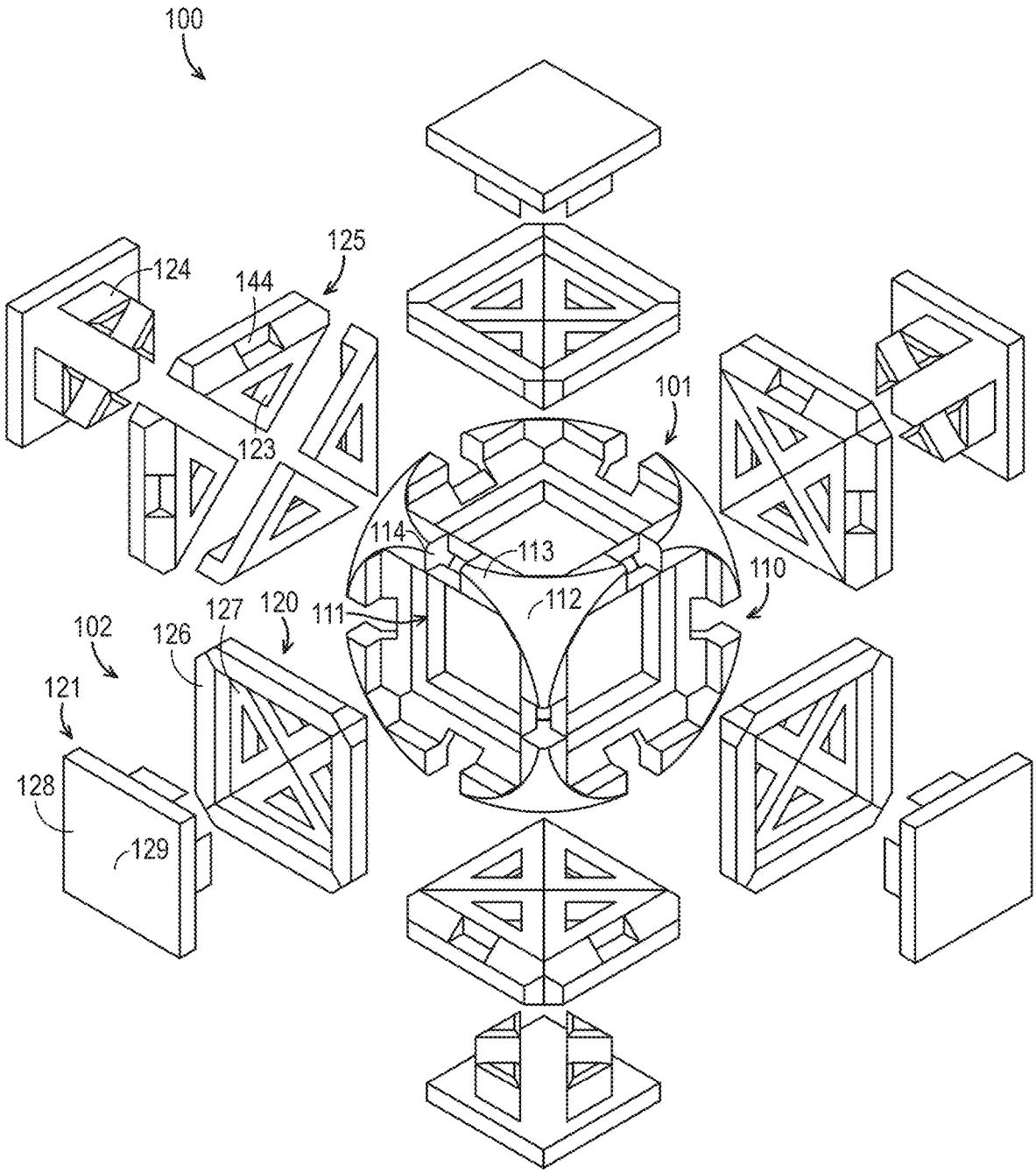
FIG. 2 is an exploded view of the customizable die shown in FIG. 1.
Figure 3:
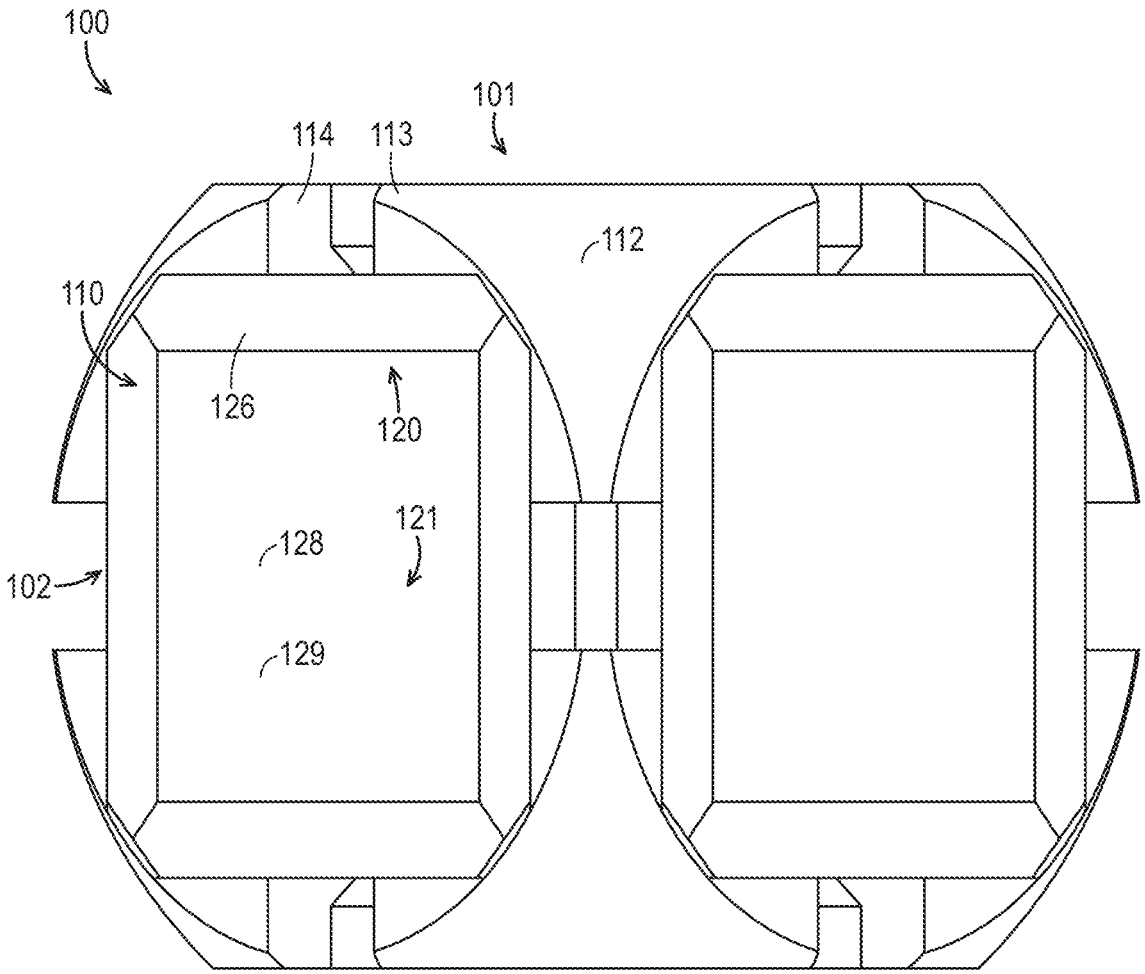
FIG. 3 is a side elevation view of the customizable die shown in FIG. 1 at an angle.
Figure 4:
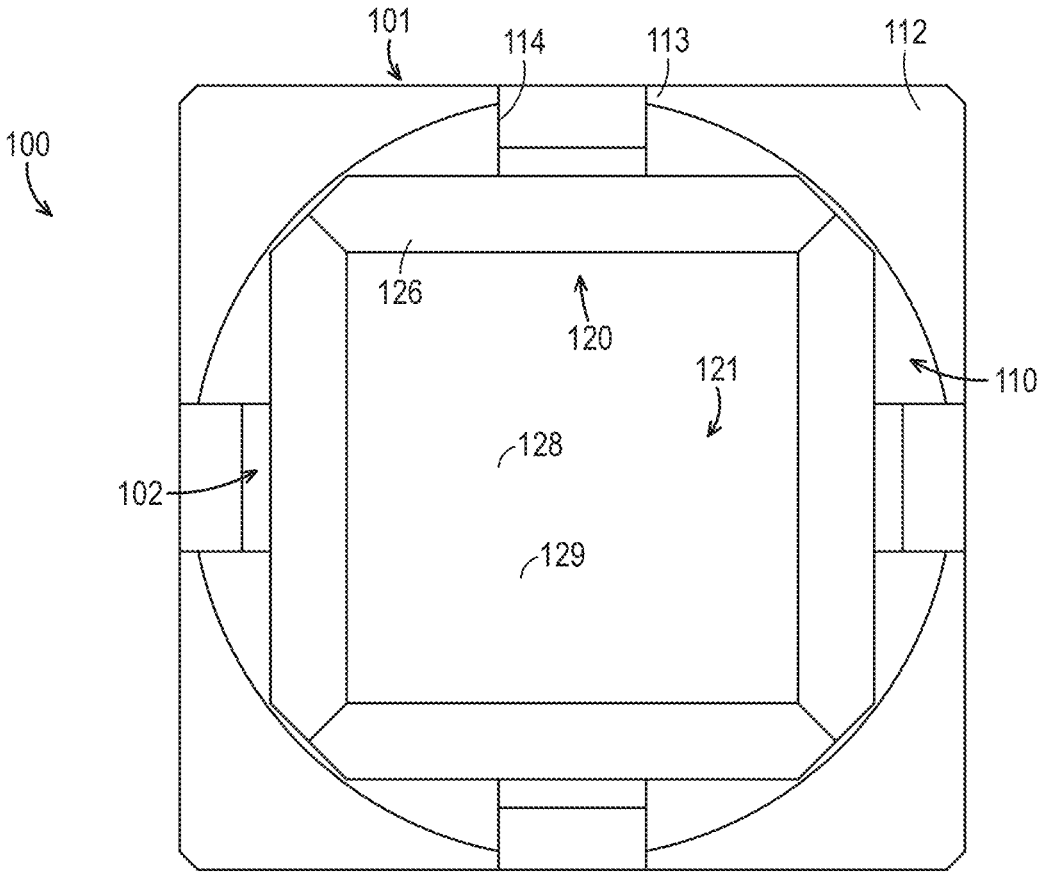
FIG. 4 is a front view of the customizable die shown in FIG. 1.

As apparent in FIGS. 1-3, corner members 112 and edge members 113 are curved in the present example. In other example, the corner members and/or edge members may be angular. In such examples, the corner members may define points. Corner members 112 and edge members 113 being curved has been observed to cause customizable die to roll smoother and quieter over support surfaces than examples where the corner members and edge members are angular and terminate in points and sharp edges, respectively.

With reference to FIG. 2, the reader can see that body 101 defines sockets 111 in sides 110. FIGS. 1-4 demonstrate that face assemblies 102 selectively mount to body 101 in sockets 111.

In the example shown in FIGS. 1-4, sockets 111 are defined in each of the six sides 110 of body 101. However, in some examples, the body defines fewer sockets than it has sides. Expressed another way, the body may have certain sides with sockets defined in them and other sides that do not have sockets defined in them. For example, a body with eight total sides may have sockets defined in three of the sides and not have sockets defined in five of the sides. The sides without sockets defined in them may present fixed die outcome displays rather than interchangeable die outcome displays.

As shown in FIG. 3, sockets 111 are configured such that face assemblies 102 are slightly recessed from outer peripheries of sides 110 of the polyhedron when face assemblies 102 are selectively mounted to body 101 in sockets 111. FIG. 3 highlights how face assemblies 102 are slightly recessed relative to corner members 112 and edge members 113. In some examples, the sockets are configured such that the face assemblies are flush with the outer peripheries of the sides and flush with the corner members and edge members.

With reference to FIG. 2, the reader can see that edge members 113 define body notches 114. Body notches 114 facilitate selectively dismounting face assemblies 102 from body 101. Body notches 114 provide access to a portion of a backside of face assemblies 102 to facilitate pushing or pulling face assemblies 102 out of sockets 111.

In the present example, body notches 114 are defined in medial portions of edge members 113, but may in other locations along the edge members. As shown in FIG. 2, body notches 114 align with frame notches 144 defined in frames 120 of face assemblies 102. Body notches 114 and frame notches 144 being aligned enables the notches to cooperate to assist with selectively removing face assemblies 102 from sockets 111.

Face Assemblies

Face assemblies 102 serve to present die outcome displays on sides 110 of body 101. In particular, face assemblies 102 are configured to present interchangeable die outcome displays by selectively mounting within sockets 111 of body 101 with different indicia displayed by them.

As apparent from FIGS. 1-4, customizable die 100 includes a face assembly 102 for each side 110 of body 101. However, other examples may include fewer or additional face assemblies. For example, a customizable die may have twelve sides with eight face assemblies and four of the sides being fixed; that is, four of the sides may not be configured to a receive a removable face assembly.

As shown in FIG. 2, face assemblies 102 are configured to selectively mount to body 101. In particular, face assemblies 102 selectively mount to body 101 in sockets 111. In the present example, face assemblies 102 can interchangeably mount to any of sockets 111. In some examples, however, certain face assemblies are configured to mount to selected sockets and restricted from mounting to other sockets.

In the example shown in FIGS. 1-4, each face assembly 102 includes a frame 120 and a face member 121. The components of face assemblies 102 are discussed in the sections below.

Frame

Frame 120 facilitates selectively mounting face assembly 102 to body 101 within socket 111. Further, frame 120 selectively receives and supports face member 121. As shown in FIG. 1, frame 120 also displays secondary indicia 131A-C.

As shown in FIG. 2, frame 120 is complementarily configured with socket 111. The complementary size and shape of frame 120 with socket 111 enables frame 120 to selectively mount within socket 111.

As apparent from FIG. 2, frame 120 defines recesses 123. Recesses 123 serve to receive studs 124 of face member 121 when face member 121 selectively mounts to frame 120. Recesses 123 and studs 124 cooperate to define a snap-fit arrangement between face member 121 and frame 120.

The reader can see in FIG. 2 that frame 120 defines four recesses 123 and that face member 121 correspondingly includes four studs 124. However, the frame may define fewer or additional recesses in other examples. Recesses 123 are disposed at medial positions of frame 120 and are aligned with studs 124 when frame 120 is disposed within socket 111.

The size and shape of recesses 123 and studs 124 are complementary. For example, as shown in FIG. 2, recesses 123 and studs 124 are triangular and of comparable size to enable studs 124 to insert into recesses 123. In other examples, the recesses and studs may be round, square, other regular polygons, or complementary irregular shapes.

The reader can see in FIG. 2 that frame 120 includes frame sections 125 that may be selectively separated or brought together in an abutting arrangement. Each frame section 125 defines a recess 123. When frame sections 125 abut each other, they define a unitary frame. Frame 120 in its unitary frame configuration seats properly within socket 111 and recesses 123 are aligned with studs 124.

As depicted in FIG. 2, frame 120 includes four frame sections 125. However, the number of frame sections may vary in different examples. For instance, frame examples may include a single section, two sections, three sections, or more than four sections.

As further depicted in FIG. 2, when frame sections 125 abut each other in the unitary frame configuration, frame 120 includes a border portion 126 and a back portion 127. The reader can see in FIG. 2 that border portion 126 is raised relative to back portion 127. Back portion 127 defines recesses 123 through which studs 124 of face member 121 insert.

Border portion 126 surrounds display member 128 when face member 121 is mounted to frame 120. Back portion 127 abuts a major face of display member 128 when face member 121 mounts to frame 120 with studs 124 inserted through recesses 123. A back portion 127 of frame 127 is obscured by display member 128 of face member 121 when face member 121 mounts to frame 120. As apparent in FIGS. 1, 3, and 4, border portion 126 of frame 120 is visible around face member 121 when face assembly 102 is selectively mounted to body 101 in socket 111.

Border portion 126 being visible around face member 121 enables border portion 126 to optionally display secondary indicia, such as secondary indicia examples 131A-C depicted in FIG. 1. The secondary indicia may be independent of the indicia on the display members. As a result, the secondary indicia allow for more complex and sophisticated gameplay options than would be possible without them.

FIG. 1 demonstrates various examples of secondary indicia on border portions 126. In particular, border portions 126 display secondary indicia 131A in the form of horizontal lines around graphic indicia 130A; secondary indicia 131B in the form of diagonal lines around pips indicia 130B, and secondary indicia 131C in the form of gridlines around word indicia 130C.

In the present example, border portions 126 define frame notches 144 to assist with selectively removing face assemblies 102 from sockets 111 of body 101. As shown in FIG. 2, frame notches 144 align with body notches 114 defined in body 101. Body notches 114 and frame notches 144 being aligned enables the notches to cooperate to assist with selectively removing face assemblies 102 from sockets 111.

Face Member

Face member 121 functions to display indicia corresponding to die outcome displays. Face member 121 is configured to interchangeably mount to different sides 110 of body 101 to customize die 100 as needed. Different face members with different indicia can be swapped out of die 100 to enable enhanced customization opportunities.

As shown in FIGS. 1-4, face member 121 is configured to selectively mount to frame 120. FIG. 2 demonstrates that face member 121 includes studs 124 and a display member 128.

As apparent in FIG. 2, studs 124 project from medial positions of a rear major face of display member 128. Studs 124 are complementarily configured with recesses 123. The complementary configuration between studs 124 and recesses 123 enables face member 121 to selectively couple to frame 120 by inserting studs 124 into recesses 123.

The reader can see in FIG. 2 that face member 121 includes four studs 124 and that frame 120 correspondingly defines four recesses 123. However, the face member may include fewer or additional studs in other examples. Studs 124 are disposed at medial positions of display member 128 and are aligned with recesses 123 when face member 121 is mounted to frame 120.

The size and shape of recesses 123 and studs 124 are complementary. For example, as shown in FIG. 2, recesses 123 and studs 124 are triangular and of comparable size to enable studs 124 to insert into recesses 123. In other examples, the recesses and studs may be round, square, other regular polygons, or complementary irregular shapes.

Display member 128 includes a front major face opposite the rear major face coupled to studs 124. The front major face includes an outer surface 129 opposite studs 124. FIG. 3 depicts how outer surface 129 is recessed slightly relative to corner members 112 and edge members 113. In some examples, the sockets are configured such that the outer surfaces are flush with the outer peripheries of the sides and flush with the corner members and edge members.

Outer surface 129 displays a die outcome display via indicia, such as indicia 130A-C depicted in FIG. 1. The indicia defining the die outcome display may be pips, numbers, letters, words, phrases, symbols, pictures or other graphics, colors, patterns, and combinations thereof. For example, FIG. 1 demonstrates indicia 130A in the form of a skull-and-crossbones graphic; indicia 130B in the form of two pips; and indicia 130C in the form of the word "stop." A wide variety of other indicia examples are contemplated.

In the example shown in FIGS. 1-4, all display members 128 are rectilinear. In particular, all display members are square. However, the display members may be a variety of shapes. For example, FIG. 5 demonstrates that a display member 238 may be round instead of square. Other suitable shapes include ovals, rectangles, triangles, other regular and irregular polygons, and irregular shapes.

Additional Embodiment

With reference to the figures not yet discussed, the discussion will now focus on an additional customizable die embodiment. The additional embodiment includes many similar or identical features to customizable die 100. Thus, for the sake of brevity, each feature of the additional embodiment below will not be redundantly explained. Rather, key distinctions between the additional embodiment and customizable die 100 will be described in detail and the reader should reference the discussion above for features substantially similar between the different customizable die examples.

Second Embodiment

Turning attention to FIG. 5, a second example of a customizable die, customizable die 200, will now be described. As can be seen in FIG. 5, customizable die 200 includes a body 201 and face assemblies 202.

A distinction between customizable die 200 and customizable die 100 is that one of face assemblies 202 has a round frame 220A and a round face member 221A along with round frames 220B and square face members 221B. Of course, other face assemblies could be round as well. Additionally or alternatively, the face assemblies could be a combination of shapes other than round or square.

While FIG. 5 depicts round frames 220A and 220B, a subset of the frames could be rectilinear like frames 120 depicted in the customizable die 100. In examples where rectilinear frames were used, the corresponding sockets are configured to complement the rectilinear shape of the frame. The reader should understand that the customizable dice described herein may include a combination of rectilinear and round frames along with bodies having sockets configured to accommodate different shaped frames.

As shown in FIG. 5, frame 220 includes round recesses 223 and a round border portion 226. As further apparent in FIG. 5, face member 221 includes round studs 224 and a round display member 228. The function and interconnections of frame 220 and face member 221 are the same as described above in the customizable die 100 example, but the different shape of round face assembly 202 may have different gameplay significance.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A customizable die, comprising:

a body defining:

a polyhedron with sides; and a socket in each side; and a face assembly for each side of the polyhedron, each face assembly configured to selectively mount to the body in the socket and including:

a frame complementarily configured with the socket and configured to selectively mount within the socket, the frame defining a recess; and a face member configured to selectively mount to the frame, the face member including:

a stud complementarily configured with the recess and configured to insert into the recess to selectively mount the face member to the frame; and a display member coupled to the stud and including an outer surface opposite the stud for displaying a die outcome display.

2. The customizable die of claim 1, wherein the stud and the recess cooperate to define a snap-fit arrangement between the face member and the frame.

3. The customizable die of claim 1, wherein the die outcome display includes indicia.

4. The customizable die of claim 3, wherein the indicia include one or more of a pip and a graphic.

5. The customizable die of claim 1, wherein a border portion of the frame is visible around the face member when the face assembly is selectively mounted to the body in the socket.

6. The customizable die of claim 5, wherein the border portion of the frame displays secondary indicia.

7. The customizable die of claim 1, wherein the outer surface of the face member is recessed from or flush with the side of the polyhedron when the face assembly is selectively mounted to the body in the socket.

8. The customizable die of claim 1, wherein the body includes corner members at each vertex of the polyhedron.

9. The customizable die of claim 8, wherein the corner members are curved.

10. The customizable die of claim 8, wherein the outer surface of the face member is recessed or flush relative to the corner members when the face assembly is selectively mounted to the body in the socket.

11. The customizable die of claim 1, wherein the display member is rectilinear.

12. The customizable die of claim 1, wherein the display member is round.

13. The customizable die of claim 1, wherein:

the recess is triangular; and the stud is triangular.

14. The customizable die of claim 1, wherein:

the frame defines four recesses; and the face member includes four studs complementarily configured with the four recesses.

15. The customizable die of claim 1, wherein the body defines edge members along peripheral edges of each side of the polyhedron.

16. The customizable die of claim 15, wherein at least one of the edge members defines a body notch to facilitate dismounting the face assembly from the body.

17. The customizable die of claim 1, wherein the frame defines a frame notch to facilitate selectively dismounting the face member from the frame.

18. The customizable die of claim 17, wherein the frame notch is aligned with a body notch when the face assembly is mounted to the body.

19. The customizable die of claim 1, wherein the polyhedron defines six sides.

20. The customizable die of claim 1, wherein:

the frame includes two or more frame sections, each frame section defining a recess;

the face member includes multiple studs corresponding to the number of frame sections included in the frame; and the frame sections abut each other to define a unitary frame held together when the multiple studs extend through the recesses defined in the frame sections.

* * * * *